US009291928B2

(12) United States Patent
Yoshida et al.

(10) Patent No.: US 9,291,928 B2
(45) Date of Patent: Mar. 22, 2016

(54) TONER CONTAINING AROMATIC MATERIALS AND METHOD OF FORMING AN IMAGE USING THE SAME

(71) Applicants: KABUSHIKI KAISHA TOSHIBA, Tokyo (JP); TOSHIBA TEC KABUSHIKI KAISHA, Tokyo (JP)

(72) Inventors: Maiko Yoshida, Mishima Shizuoka (JP); Satoshi Araki, Mishima Shizuoka (JP); Taishi Takano, Shimizu Shizuoka (JP); Takashi Urabe, Shimizu Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/540,963

(22) Filed: Nov. 13, 2014

(65) Prior Publication Data

US 2015/0132697 A1 May 14, 2015

(30) Foreign Application Priority Data

Nov. 14, 2013 (JP) ..... 2013-236227

(51) Int. Cl.
*G03G 9/08* (2006.01)
*G03G 9/087* (2006.01)

(52) U.S. Cl.
CPC ..... *G03G 9/0825* (2013.01); *G03G 9/081* (2013.01); *G03G 9/0804* (2013.01); *G03G 9/087* (2013.01); *G03G 9/08755* (2013.01); *G03G 9/08795* (2013.01)

(58) Field of Classification Search
CPC ..... G03G 9/0935; G03G 9/09392
See application file for complete search history.

(56) References Cited

U.S. PATENT DOCUMENTS 5,484,677 A * 1/1996 Inaba ..... G06G 9/09321 264/4.7
8,252,496 B2 8/2012 Kabai et al.

FOREIGN PATENT DOCUMENTS

JP H03-048861 3/1991
JP H05-214283 8/1993
JP 2003-173041 6/2003

* cited by examiner

*Primary Examiner* — Hoa V Le
(74) *Attorney, Agent, or Firm* — Foley & Lardner LLP

(57) ABSTRACT

A toner includes toner particles, each containing binder resin and a plurality of microcapsules dispersed therein, each of the microcapsules containing a liquid material. A method for forming an image on a medium includes forming an electrostatic latent image on a carrier, forming a toner image by developing the electrostatic latent image using the toner, transferring the toner image onto a medium, and fixing the transferred toner image on the medium.

20 Claims, 1 Drawing Sheet

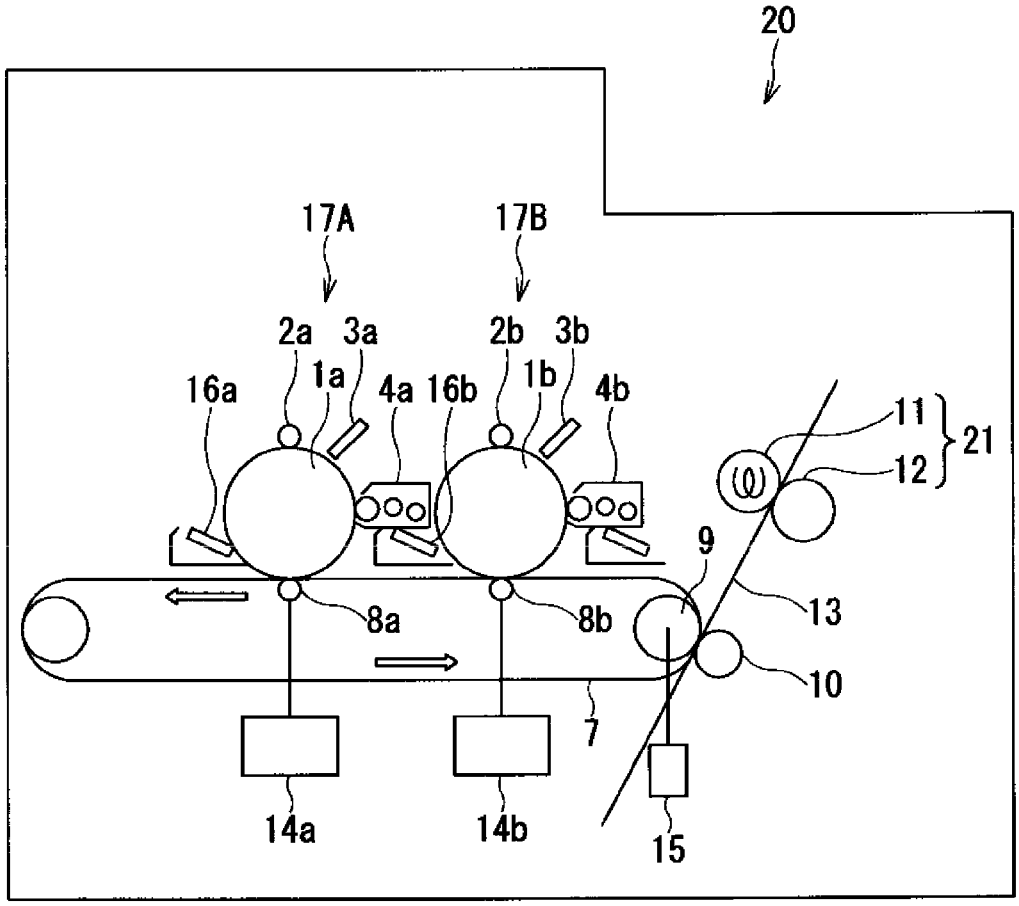
20
17A
17B
2a
3a
2b
3b
16a
1a
4a
16b
1b
4b
11
12
21
9
13
8a
8b
10
7
14a
14b
15

TONER CONTAINING AROMATIC MATERIALS AND METHOD OF FORMING AN IMAGE USING THE SAME

CROSS-REFERENCE TO RELATED APPLICATION

This application is based upon and claims the benefit of priority from Japanese Patent Application No. 2013-236227, filed Nov. 14, 2013, the entire contents of which are incorporated herein by reference.

FIELD

Embodiments described herein relate to toner containing aromatic materials and a method of forming an image on a medium using the same.

BACKGROUND

Color materials used as toner for electrophotography are generally one of four colors, which are yellow, magenta, cyan, and black. Today, new toner materials are in demand for various purposes such as cards, pamphlets, and direct mails.

One type of toner contains a material that neutralizes an odor produced during an image forming process. Because such a material is used, it is difficult to differentiate an image formed with such a toner and an image formed with conventional toner.

DESCRIPTION OF THE DRAWINGS

FIG. 1 is a schematic view of an image forming device for printing using a toner containing aromatic materials dispersed therein.

DETAILED DESCRIPTION

Exemplary embodiments provide toner which may keep aromatic materials contained therein over a long period of time.

In general, according to one embodiment, there is provided a toner comprising toner particles, each containing binder resin and a plurality of microcapsules dispersed therein, each of the microcapsules containing a liquid material.

In addition, according to another embodiment, there is provided a method of forming an image on a medium comprising forming an electrostatic latent region, forming a toner image on the electrostatic latent region using a toner including toner particles, each containing binder resin and a plurality of microcapsules dispersed therein, each of the microcapsules containing a liquid material, transferring the formed toner image onto a medium, and fixing the transferred toner image on the medium.

In the exemplary embodiments, each microcapsule dispersed in the toner particle encapsulates a liquid aromatic fragrance or aromatic fragrant liquid which is diluted with an odorless organic solvent. The microcapsule is prevented from destruction during printing or image forming through electrophotography in part because the toner particles are dispersed in the matrix resin. After printing using the toner particles containing the microcapsules, it is possible to release the liquid fragrance and to disperse the aroma of the liquid fragrance by applying acupressure, finger friction, and other adequate capsule destruction ways to the microcapsules.

Hereinafter, exemplary embodiments will be described with reference to the drawing. In the following description, "parts" and "%", which represent a composition, are based on weight unless otherwise specified.

As described above, exemplary embodiments provide toner including the toner particles, each containing binder resin and microcapsules dispersed therein, each of which contains the liquid material.

Matrix Resin

The matrix resin is equivalent to a general toner particle component for electrophotography, and is the entire component of the toner particle except for the microcapsule containing the liquid. Specifically, the matrix resin contains at least binder resin, and as necessary, other additives such as a mold-releasing agent, a colorant, and an electrification control agent. The matrix resin does not include an external additive which is externally added to the toner particle.

Binder Resin

Examples of the binder resin include: styrene-based resins such as polystyrene, styrene-butadiene copolymers, and styrene-acrylic copolymers; ethylene-based resins such as polyethylene, polyethylene-vinyl acetate copolymers, polyethylene-norbornene copolymers, and polyethylene-vinyl alcohol copolymers; polyester resins; acrylic resins; phenolic resins; epoxy resins; allyl phthalate resins; polyamide resins; and maleic acid resins.

More specifically, the binder resin may be obtained by polymerizing vinyl polymerizable monomers: for example, aromatic vinyl monomers such as styrene, methylstyrene, methoxystyrene, phenyl styrene and chlorostyrene; ester-based monomers such as methyl acrylate, ethyl acrylate, butyl acrylate, methyl methacrylate, ethyl methacrylate and butyl methacrylate; carboxylic acid-containing monomers such as acrylic acid, methacrylic acid, fumaric acid, and maleic acid; amine-based monomers such as amino acrylate, acrylamide, methacrylamide, vinylpyridine, and vinylpyrrolidone; and derivatives thereof alone or in combination of a plural kinds thereof.

The binder resin may also be obtained by polycondensation of polycondensation-based polymerizable monomer formed of an alcohol component and a carboxylic acid component. As the alcohol component it is possible to use following: aliphatic diols such as ethylene glycol, 1,3-propanediol, 1,4-butanediol, 1,5-pentanediol, 1,6-hexanediol, 1,7-heptanediol, 1,8-octanediol, 1,9-nonane diol, 1,10-decanediol, 1,4-butenediol, 1,2-propanediol, 1,3-butanediol, neopentyl glycol, and 2-butyl-2-ethyl-1,3-propanediol; aromatic diols such as alkylene oxide adducts of bisphenol A such as polyoxypropylene(2.2)-2,2-bis(4-hydroxyphenyl)propane, polyoxyethylene(2.2)-2,2-bis(4-hydroxyphenyl)propane; trihydric or higher polyhydric alcohols such as glycerin and pentaerythritol; and derivatives thereof alone or by mixing plural kinds thereof. As the carboxylic acid component, it is possible to use following: aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecyl succinic acid, and n-dodecenyl succinic acid; alicyclic dicarboxylic acids such as cyclohexane dicarboxylic acid; aromatic dicarboxylic acids such as phthalic acid, isophthalic acid, and terephthalic acid; trihydric or higher polycarboxylic acids such as trimellitic acid and pyromellitic acid; and derivatives thereof alone or by mixing plural kinds thereof.

When the above-described monomers are polymerized, it is possible to use all of well-known assistants such as chain transfer agents, cross-linking agents, polymerization initiators, surfactants, aggregating agents, pH adjusting agents, and defoaming agents, as polymerizing agents for producing a toner.

As the chain transfer agents, carbon tetrabromide, dodecyl mercaptan, trichlorobromomethane, dodecanethiol, and the like are used.

Cross-linking agents, which have two or more unsaturated bonds, such as divinyl benzene, divinyl ether, divinyl naphthalene, and diethylene glycol methacrylate are used as the cross-linking agent.

It is necessary to selectively use polymerization initiators depending on the polymerization method and there are two types which are a water-soluble initiator and an oil-soluble initiator. As the water-soluble initiator, persulfate such as potassium persulfate and ammonium persulfate; azo-based compounds such as 2,2-azobis-(2-aminopropane); hydrogen peroxide; benzoyl peroxide; and the like are used. In addition, as the oil-based initiator, azo-based compound such as azobisisobutyronitrile and azobisdimethylvaleronitrile; and peroxide such as benzoyl peroxide and dichlorobenzoyl peroxide are used. In addition, it is possible to use redox-based initiators if necessary.

As the surfactants, it is possible to use anionic surfactants, cationic surfactants, amphoteric surfactants, and nonionic surfactants. Examples of the anionic surfactants include fatty acid salts, alkyl sulfate ester salts, polyoxyethylene alkyl ether sulfuric acid ester salts, alkylbenzene sulfonate, alkyl naphthalene sulfonate, dialkyl sulfosuccinate, alkyl diphenyl ether disulfonates, polyoxyethylene alkyl ether phosphates, alkenyl succinnates, alkane sulfonates, naphthalenesulfonic acid-formalin condensate salts, aromatic sulfonic acid formalin condensate salts, polycarboxylic acids, and polycarboxylates. Examples of the cationic surfactants include alkyl amine salts and alkyl quaternary ammonium salts. Examples of the amphoteric surfactants include alkyl betaine and alkyl amine oxides. Examples of the nonionic surfactants include polyoxyethylene alkyl ethers, polyoxyalkylene alkyl ethers, polyoxyethylene derivatives, sorbitan fatty acid esters, polyoxyethylene sorbitan fatty acid esters, polyoxyethylene sorbitol fatty acid esters, glycerin fatty acid esters, polyoxyethylene fatty acid esters, polyoxyethylene hydrogenated castor oil, polyoxyethylene alkylamine, and alkyl alkanol amide. These may be used alone or in combination of plural kinds thereof.

As the aggregating agents, following can be used: monovalent salts such as sodium chloride, potassium chloride, lithium chloride, and sodium sulfate; divalent slats such as magnesium chloride, calcium chloride, magnesium sulfate, calcium nitrate, zinc chloride, ferric chloride, and ferric sulfate; and trivalent salts such as aluminum sulfate and aluminum chloride. In addition, organic aggregating agents such as quaternary ammonium salts such as poly-hydroxypropyl dimethyl ammonium chloride and polydiallyl dimethyl ammonium chloride, or organic polymer aggregating agents may be used.

As the pH adjusting agents, it is possible to use following: acids such as hydrochloric acid, sulfuric acid, nitric acid, acetic acid, citric acid, and phosphoric acid; and alkalis such as sodium hydroxide, potassium hydroxide, ammonia, and amine compounds. Examples of the amine compounds include dimethylamine, trimethylamine, monoethylamine, diethylamine, triethylamine, propylamine, isopropylamine, dipropylamine, butylamine, iso-butylamine, sec-butylamine, monoethanolamine, diethanolamine, triethanolamine, triisopropanolamine, isopropanolamine, dimethylethanolamine, diethyl ethanolamine, N-butyl diethanolamine, N,N-dimethyl-1,3-diaminopropane, and N,N-diethyl-1,3-diaminopropane. In addition, surfactants exhibiting acidity or alkaline may also be used.

As the defoaming agents, it is possible to use a lower alcohol-based defoaming agent, an organic polar compound-based defoaming agent, a mineral oil-based defoaming agent, and a silicone-based defoaming agent. As the lower alcohol-based defoaming agent, it is possible to use methanol, ethanol, isopropanol, butanol, and the like. As the organic polar compound-based defoaming agent, it is possible to use 2-ethylhexanol, amyl alcohol, diisobutyl carbinol, tributyl phosphate, oleic acid, tall oil, metal soaps, sorbitan monolaurate, sorbitan oleic acid monoester, sorbitan oleic acid triester, low-molecular-weight polyethylene glycol oleic acid ester, nonylphenol EO low molar adduct, pluronic EO low molar adduct, polypropylene glycol, derivatives thereof, and the like. As the mineral oil-based defoaming agent, it is possible to use a surfactant-mixed product of mineral oil, a surfactant-mixed product of mineral oil and fatty acid metal salt, and the like. As the silicone based defoaming agent, it is possible to use silicone resin, a surfactant-mixed product of silicone resin, inorganic powder-mixed product of silicone resin, and the like.

The binder resin obtained as described above may be used alone or in a combination of two or more thereof. In addition, the glass transition temperature (Tg) of the resins may be 25° C. to 80° C. and the softening point thereof may be 80° C. to 180° C.

As the binder resin, the polyester resin having good fixability and less aroma inhibition component is particularly preferable. In addition, it is preferable that the acid value of the polyester resin be 1 mgKOH/g or greater. With the possession of the acid value, it is possible to exhibit the effect of an alkaline pH adjusting agent in atomization for forming a fine particle adequate to the aggregation method to be described later, and to obtain a fine particle having a small particle size.

It is particularly preferable that the glass transition temperature be 25° C. to 65° C. If the glass transition temperature is too high, the fragrance-containing microcapsule cannot be destructed by simple ways such as finger friction performed on a toner printing layer, and therefore, it is difficult to disperse the aromas.

It is more preferable that the softening point be 90° C. to 160° C. since the fragrant component does not volatilize during fixing upon production. In addition, the above-described softening point is preferable since there is a high possibility that the printed matter using the toner of an exemplary embodiment disperses fragrances by rubbing of the image using a finger, and higher fixation fastness is required. In addition, it is preferable that odorless resin or resin with a less odor be used as possible so as not to interfere with the fragrance.

The glass transition point and the softening point of the matrix resin is substantially determined by the binder resin as the above-described main component, but may be adjusted to some extent by addition of the following mold-releasing agents.

Mold-Releasing Agent

The mold-releasing agent is not necessary for the matrix resin of the toner particle. However, the mold-releasing agent may be used if the toner is fixed at a low temperature, or used for preventing any contamination on a roller surface during thermal fixing, or for improving friction resistance of a printed material.

Examples of the mold-releasing agents include following: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax, or block copolymers thereof; botanical waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having fatty acid esters as a main component, such as montan acid ester wax and castor wax; and mold-releasing agents, in which all or part of fatty acid esters is deoxidized, such as deoxidized carnauba wax. Furthermore, examples thereof include following: saturated straight chain fatty acids such as palmitic acid, stearic acid, montanic acid, or long-chain alkyl carboxylic acids further having a long-chain alkyl group; unsaturated fatty acids such as brassidic acid, eleostearic acid, parinaric acid; saturated alcohols such as stearyl alcohol, eicosyl alcohol, behenyl alcohol, carnaubyl alcohol, ceryl alcohol, melissyl alcohol, or long-chain alkyl alcohols further having a long-chain alkyl group; polyhydric alcohols such as sorbitol; fatty acid amide such as linoleic acid amide, oleic acid amide, and lauric acid amide; saturated fatty acid bis-amide such as methylene-bis-stearic acid amide, ethylene-bis-capric acid amide, ethylene-bis-lauric acid amide, and hexamethylene-bis-stearic acid amide; unsaturated fatty acid amide such as ethylene-bis-oleic acid amide, hexamethylene-bis-oleic acid amide, N,N'-dioleyl adipic acid amide, and N,N'-dioleylsebacic acid amide; aromatic-bis amide such as m-xylene bis-stearic acid amide and N,N'-distearylisophthalic acid amide; fatty acid metal salt (which is generally called metal soap) such as calcium stearate, calcium laurate, zinc stearate, and magnesium stearate; waxes obtained by grafting a vinyl monomer such as styrene or acrylic acid to aliphatic hydrocarbon waxes; partially esterified products of fatty acids and polyhydric alcohols, such as behenic acid monoglyceride; and methyl ester compounds having a hydroxyl group obtained by hydrogenating vegetable oils. In addition, it is preferable that odorless mold-releasing agents or mold-releasing agents with a less odor which are properly purified be used so as not to interfere with fragrance.

It is preferable that content ratio of mold-releasing agent be relatively small, which is 1% to 20% with respect to the whole toner even if it is used, in order to prevent bleeding-out of the fragrance from a microcapsule after printing, and volatilization of the fragrance.

Other Additives

It is possible to add electrification control agents or antioxidants to the matrix resin as necessary.

Examples of the electrification control agent include a metal-containing azo compound, and preferably a complex or a complex salt of iron and cobalt chrome, and a mixture thereof. In addition, a metal-containing salicylic acid derivative compound may also be used, and preferably a complex or a complex salt of zirconium, zinc, chromium, and boron which are metallic elements, and a mixture thereof.

Fragrance-Containing Microcapsule

Fragrance

As a liquid fragrance encapsulated in a fragrance-containing microcapsule, a well-known oily fragrance or a diluted solution thereof is used. Examples of the oily fragrance include bromostyrene, phenylethyl alcohol, linalool, hexylcinnamic aldehyde, α-limonene, benzyl aldehyde, eugenol, bornyl aldehyde, citronellal, korolal, terpineol, geraniol, menthol, and cinnamic acid. Moreover, it is preferable that the naturally or synthetically compounded fragrance be used as a diluted solution by adding an odorless solvent such as benzyl benzoate.

Microencapsulation

Examples of the resin used as a wall film of the microcapsule encapsulating the above-described liquid fragrance include urea-formaldehyde resin, melamine-formaldehyde resin, guanamine-formaldehyde resin, a sulfonamide-aldehyde resin, and aniline-formaldehyde resin. Particularly, the melamine-formaldehyde resin is preferable because it has favorable water resistance, chemical resistance, solvent resistance, and aging resistance.

Examples of encapsulation methods include an interfacial polymerization method, coacervation method, in-situ polymerization method, in-liquid drying method, and in-liquid cured coating method. Particularly, the in-situ polymerization method using melamine resin as a shell component, the interfacial polymerization method using urethane resin as the shell component, and the like are favorable. In the in-situ polymerization method, first, the above-described oily fragrance (or the diluted solution thereof) is emulsified in a water-soluble polymer or an aqueous surfactant solution. Then, it is possible to encapsulate the mixture by adding an aqueous melamine-formalin prepolymer solution thereto and heating and polymerizing the mixture. It is preferable to continue the polymerization by adding by a small amount the aqueous prepolymer solution while the pH of the system is adjusted to an acidic pH.

In the case of the interfacial polymerization method, the above-described three components and a polyvalent isocyanate prepolymer are dissolved and mixed, and are emulsified in a water-soluble polymer or an aqueous surfactant solution. Then, it is possible to encapsulate the mixture by adding a polyvalent base such as diamine or diol thereto and heating and polymerizing the mixture.

It is preferable that the wall film resin be used in a ratio of 0.1 parts to 1 part, and particularly, 0.2 parts to 0.5 parts, with respect to 1 part of the liquid fragrance. It is preferable that the fragrance-containing microcapsules be dispersed in a toner particle in a ratio of 0.5 parts to 30 parts, and particularly, 1 part to 15 parts per 100 parts of matrix resin. In addition, it is preferable that the volume average particle size of the fragrance-containing microcapsule be 0.10 μm to 10 μm, and particularly, 0.5 μm to 5 μm. If the volume average particle size thereof is less than 0.10 μm, it is difficult to efficiently volatilize fragrance because the microcapsule is less likely to be destructed. If the volume average particle size thereof is greater than 10 μm, the particle size of the toner becomes large and the image quality tends to deteriorate when the tone is mixed with a color material for use. In addition, it is preferable that the volume average particle size of the fragrance-containing microcapsule be 1% to 70%, and particularly, 10% to 50% of the volume average particle size (generally 3 μm to 20 μm, and preferably 3 μm to 15 μm) of the toner particle to be formed.

Colorant

The toner of an exemplary embodiment includes microencapsulated liquid fragrance, and the toner may contain a colorant (colored aromatic toner) and may not contain a colorant (non-colored aromatic toner). In order to provide the colored aromatic toner, it is preferable that the matrix resin contain a colorant to avoid interaction with the oily fragrance. In addition, in order to avoid blur of an image or a printed matter due to the oily fragrance released after the destruction of the microcapsule, it is preferable to use organic or inorganic pigments containing carbon black, instead of dyes.

Examples of the carbon black include acetylene black, furnace black, thermal black, channel black, and Ketjen black. In addition, examples of yellow pigments include following: C. I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, 185; and C. I. Vat Yellow 1, 3, 20. These may be used singly or in combination thereof. In addition, examples of magenta pigments include following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, 238; C. I. Pigment Violet 19; and C. I. Vat Red 1, 2, 10, 13, 15, 23, 29, 35. These may be used singly or in combination thereof. In addition, examples of cyan pigments include following: C. I. Pigment Blue 2, 3, 15, 16, 17; C. I. Vat Blue 6; and C. I. Acid Blue 45. These may be used singly or in combination thereof.

Formation of Toner Particle

In exemplary embodiments, a toner particle is formed by dispersing microcapsules containing a liquid fragrance in matrix resin including at least binder resin. Specifically, there are various modes as described below.

I. A method of forming a toner particle by melting matrix resin containing at least binder resin and melting and kneading the melt matrix resin with a microcapsule containing a liquid fragrance, that is, a method of melting, kneading, and grinding.

A kneader is not particularly limited as long as it is possible to perform the melting and kneading, and examples thereof include a single-screw extruder, a double-screw extruder, a pressure type kneader, a Banbury mixer, and a Brabender mixer. Specific examples thereof include FCM (manufactured by Kobe Steel, Ltd.), NCM (manufactured by Kobe Steel, Ltd.), LCM (manufactured by Kobe Steel, Ltd.), ACM (manufactured by Kobe Steel, Ltd.), KTX (manufactured by Kobe Steel, Ltd.), GT (manufactured by Ikegai Corp.), PCM (manufactured by Ikegai Corp.), TEX (manufactured by Japan Steel Works, LTD.), TEM (manufactured by Toshiba Machine Co., Ltd.), ZSK (manufactured by Werner Corp.), and Kneadex (manufactured by Mitsui Mining Co., Ltd.).

A grinder is not particularly limited as long as it is possible to grind in a dry state, and examples thereof include a ball mill, an atomizer, a bantam mill, a pulverizer, a hammer mill, a roll crusher, a cutter mill, and a jet mill.

II. A method of forming a toner particle through granulating of the matrix resin in an aqueous medium that coexists with a microcapsule containing a liquid fragrance, that is, a wet granulation method. The wet granulation method is more preferable than the method of I in terms of homogeneity of a fine structure or characteristics of the toner particle, and in terms of less damage of the microcapsule during the granulation. The method is further subdivided into the following.

(1) A method of forming toner particles by polymerizing a composition containing the microcapsule and a precursor monomer of the binder resin which are dispersed in an aqueous medium.

A suspension polymerization method of the above-described vinyl polymerizable monomer is generally used.

(2) A method of forming toner particles as aggregated particles in such a manner that a microcapsule containing a liquid fragrance and a matrix resin fine particle which are dispersed in an aqueous medium are aggregated, that is, a wet aggregation method. In general, the wet aggregation method is more preferable than the method of (1) in that it is possible to form a toner particle at a relatively low temperature and it is possible to avoid thermal deterioration of the fragrance-containing microcapsule in the process of forming the toner particle (in the present disclosure, the term "fine particle" is a particle before the aggregation, simply indicates that the fine particle is relatively small with respect to the particle after the aggregation, and does not specify absolute particle sizes, and therefore, there is no problem in calling the term itself as a "particle"). The following process (2a) is included in the method.

(2a) Formation of a Fine Particle (or its Aqueous Dispersion Liquid) of Matrix Resin (or its Component)

There are various methods. Examples of the methods include, in a case of a dispersion liquid of a binder resin particle, following: polymerization methods such as emulsion polymerization, seed polymerization, mini-emulsion polymerization, suspension polymerization, interfacial polymerization, and in-situ polymerization, in which a monomer or a resin intermediate is polymerized; a phase inversion emulsification method in which a particle is obtained by forming an oil phase by softening the binder resin using a solvent, alkalinity, and a surfactant or using heat, and by adding a water phase having water as a main component; and a mechanical emulsification method of softening the binder resin using a solvent or heat and mechanically atomizing the softened binder resin in an aqueous medium using a high pressure atomization machine, a rotor and stator type stirring machine, or the like. In a case of mold-releasing agent particle dispersion liquid, electrification control agent particle dispersion liquid, and pigment dispersion liquid, it is possible to obtain a particle through a mechanical atomization method or the like in which the materials are mechanically atomized in an aqueous medium using a high pressure atomization machine, a rotor and stator type stirring machine, a medium-type atomization machine, or the like. The components of the matrix resin which are separately obtained may be collectively or sequentially added to aqueous dispersion liquid of a fragrance-containing microcapsule which is preferably prepared in advance in the aggregating with the fragrance-containing microcapsule to be described later.

Meanwhile, in addition to the methods of separately preparing fine particles, there is a method of melting and kneading, or mixing the components of the matrix resin, and mechanically atomizing the resultant in an aqueous medium using a high pressure atomization machine, a rotor and stator type stirring machine, a medium-type atomization machine, or the like. The method is an extremely excellent production method because it is possible to simplify the process as the matrix resin fine particle may be prepared integrally, and because it is possible to more uniformly disperse the mold-releasing agents, the electrification control agents, and the like in the binder resin.

The matrix resin fine particle may be obtained by, for example, subjecting dispersion liquid of a resin particle which contains at least binder resin to mechanical shearing, to atomize the resin particle and to obtain a fine particle having a particle size smaller than the particle size of the resin particle.

As a specific example of the mechanical shearing, there is a method of preparing the matrix resin fine particle using a high pressure atomization machine, which is a method of mechanical emulsification.

First, a particle of matrix resin which is coarsely granulated is prepared. To do so, in addition to the use of the grinders shown in the above-described method of I, a coarsely grinding of melting and kneading the matrix resin component is preferably employed. The coarsely granulated particle has a volume average particle size of, preferably 0.01 mm to 2 mm and more preferably 0.02 mm to 1 mm. If the volume average particle size is less than 0.01 mm, strong stirring is required to disperse the particles in an aqueous medium, and a bubble generated by the stirring tends to decrease dispersion of a mixture. If the volume average particle size is greater than 2 mm, its particle size is great compared to a gap provided in a shearing portion, and therefore, there is a tendency that the particle clogs the shearing portion, or that a particle having a non-uniform composition or particle size due to the difference of supplied energy between the inside and the outside of the mixture is generated.

Next, dispersion liquid of the coarsely granulated particle is formed by dispersing the coarsely granulated particles in an aqueous medium. In the process, it is possible to add a surfactant or an alkaline pH-adjusting agent to the aqueous medium.

With the addition of the surfactant, it is possible to more easily disperse the particles in the aqueous medium through the operation of the surfactant which is adsorbed onto a surface of the particle. The binder resin or the mold-releasing agent as the matrix resin component has low hydrophilicity and it is extremely difficult to disperse the particles in water without the surfactant.

It is preferable that a surfactant concentration at this time be equal to or more than a critical micelle concentration. The critical micelle concentration referred to herein indicates a minimum surfactant concentration required for forming a micelle in water, and may be obtained by measuring surface tension or electrical conductivity. If the surfactant of which concentration is greater than the concentration is included, the dispersion becomes more easy.

Meanwhile, it is possible to improve self-dispersibility by increasing a degree of dissociation of a dissociable functional group of the surface of the binder resin or by increasing polarity, through addition of the alkaline pH adjusting agent.

Subsequently, the obtained dispersion liquid is defoamed as necessary. The binder resin or the mold-releasing agent as the matrix resin component has low hydrophilicity, and therefore, it is possible to disperse the particles in water using a surfactant, but considerable foam entrapment occurs during mixing. When atomizing is performed using a high pressure atomization machine in a post-process, in a state where the bubble is mixed therein, an air shot is generated in a plunger of high-pressure pump, and therefore, the operation of the plunger becomes unstable. Particularly, when a plurality of plungers are continuously mounted in order to remove a pulsating flow, in some cases, it is impossible to perform the atomizing if the air shot is generated because the movement of the plurality of plungers are controlled. In addition, since the high pressure atomization machine has a check valve, if the bubble is mixed in a treatment liquid, the particle is easily attached to the check valve, thereby causing clogging of the check valve. If the clogging of the check valve occurs, in some cases, it is impossible to perform the atomizing since the treatment liquid does not flow.

Examples of the defoaming methods include vacuum reduced-pressure defoamation, centrifugal defoamation, and addition of a defoaming agent. Any methods may be used as long as bubbles may be removed. However, when the defoaming agent is added, it is necessary to select a defoaming agent which does not affect the post-process. In addition, it is important that the defoaming agent does not remain in the toner so as not to deteriorate electrification characteristics or the like. As a simple method thereof, reduced-pressure defoamation is favorable. A treatment liquid is added to a pressure resistant container having a stirring machine, and the pressure resistant container is decompressed to the extent of −0.09 MPa using a vacuum pump while the treatment liquid is stirred, to perform the defoamation.

After forming the dispersion liquid, wet grinding may be performed as necessary. By performing the grinding and further reducing the particle size, in some cases, the treatment thereafter is stabilized.

Next, for example, the obtained dispersion liquid is heated to a glass transition temperature Tg of the binder resin or higher, and is subsequently subjected to mechanical shearing by making the dispersion liquid pass through a fine nozzle while a pressure of 10 MPa to 300 MPa is applied using a high pressure atomization machine. As a result, the coarsely granulated mixture is finely granulated to form a fine particle.

Examples of the atomization machines for wet atomization include following: high-pressure atomization machines such as Nanomizer (manufactured by Yoshida kikai Co., Ltd.), Ultimizer (manufactured by Sugino Machine Limited), NANO3000 (manufactured by Beryu Corp.), Microfluidizer (manufactured by Mizuho industrial Co., Ltd.), and Homogenizer (manufactured by Izumi Food Machinery Co., Ltd.); rotor and stator type stirring machines such as Ultra-Turrax (manufactured by IKA Japan KK), TK Autohomomixer (manufactured by PRIMIX Corporation), TK pipeline homo mixer (manufactured by PRIMIX Corporation), TK Filmics (manufactured by PRIMIX Corporation), Claire Mix (manufactured by M Technique Co., Ltd.), Claire SS5 (manufactured by M M Technique Co., Ltd.), Cavitron (manufactured by Eurotec Limited), and Fine flow mill (manufactured by Pacific Machinery & Engineering Co., Ltd.); and media stirring machines such as Visco Mill (manufactured by Imex Co., Ltd.), Apex Mill (manufactured by Kotobuki Industries Co., Ltd.), Star Mill (manufactured by Ashizawa Fine Tech Ltd.), DCP super flow (manufactured by Nippon Eirich Co., Ltd.), MP Mill (manufactured by Inoue MFG., Inc.), Spike Mill (manufactured by Inoue Seisakusho), Mighty Mill (manufactured by Inoue MFG., Inc.), and SC Mill (manufactured by Mitsui Mining Co., Ltd.). The atomization machines may also be used when a matrix resin fine particle is mixed with an aggregating agent.

Finally, the dispersion liquid is cooled to the glass transition temperature Tg of the binder resin or lower. The melt fine particle is solidified through the cooling. Since the treatment liquid is rapidly cooled, aggregation or fusion due to cooling hardly occurs.

It is possible to obtain the dispersion liquid of the matrix resin fine particle.

Next, a specific example of a method of preparing an aqueous dispersion liquid of a fine particle of matrix resin containing at least binder resin through emulsion polymerization, which is one of polymerization methods, will be described.

First, oil phase components in which a vinyl-based polymerizable monomer providing the binder resin with a chain transfer agent as necessary are prepared. The oil phase components are polymerized by emulsifying and dispersing the oil phase components in water phase components which are aqueous surfactant solutions, adding an aqueous polymerization initiator thereto, and heating the mixture. The oil phase components may be mixed with a mold-releasing agent, an electrification control agent, and the like as other matrix resin components in addition to the vinyl monomer. In addition, it is possible to make the emulsion polymerization particle contain the components by adding dispersion liquid, in which fine particles such as the mold-releasing agent, electrification control agent, and the like are dispersed in an aqueous medium, in a polymerization process. It is possible to prepare fine particle dispersion liquid having a particular size of 0.01 μm to 1 μm of the matrix resin (or its component) containing at least binder resin through the emulsion polymerization. As the method of emulsion polymerization, the polymerization may be performed while the oil phase components is added to the water phase components, and the polymerization initiator may be added again during the polymerization in order to adjust the molecular weight.

Next, a specific example of a method of preparing the aqueous dispersion liquid of the fine particle of the matrix resin through a phase inversion emulsification method.

First, oil phase components containing matrix resin are heated and melted. An aqueous solution containing a surfactant and a pH adjusting agent is gradually added thereto. The phase thereof is inverted from W/O to O/W as the aqueous solution is added. It is possible to prepare the fine particle dispersion liquid of toner components which contain at least binder resin and have a particle size of 0.01 μm to 5 μm by cooling the mixture after completion of the phase inversion. Here, surfactants, pH adjusting agents, solvents, ion-exchanged water, and the like may be added to the oil phase components in advance. Particularly, when the solvents are added, in some cases, heating is unnecessary because the oil phase component has low viscosity. However, when the solvents are used, it is necessary to remove the solvents after the phase inversion emulsification.

(2b) Formation of a Toner Particle Through Aggregation and Fusion Between a Fragrance-Containing Microcapsule and a Matrix Resin Fine Particle An example of a method of aggregating and fusing at least a fragrance-containing microcapsule of an exemplary embodiment and a fine particle of a matrix resin, which contains at least binder resin, of an exemplary embodiment, in a medium such as water will be described below.

Here, as the fine particle of the matrix resin containing at least binder resin, for example, a fine particle of binder resin, a fine particle of a mold-releasing agent, and a fine particle of a electrification control agent may be combined for use, or fine particles in which a mold-releasing agent or an electrification control agent is contained in binder resin may be used. Furthermore, a mixture thereof may also be used.

It is preferable that an enlarged toner particle be formed by collectively or sequentially adding the aqueous dispersion liquid of the matrix resin fine particle obtained above or the fine particle dispersion liquid of the component of the matrix resin fine particle obtained above to an aqueous dispersion liquid of a fragrance-containing microcapsule prepared in advance, and adding a aggregating agent thereto, so that the fine particle of the matrix resin (or its component) is adhered to and aggregated in the periphery of one or a plurality of fragrance-containing microcapsules.

The volume average particle size of the fine particle of the matrix resin (or its component) before the aggregation is preferably 0.01 μm to 5.0 μm, and particularly preferably 0.05 μm to 2.0 μm, and is preferably 0.1% to 70%, and particularly preferably 0.5% to 50% of the volume average particle size of the fragrance-containing microcapsule.

The amount of aggregating agent changes depending on dispersion stability of the matrix resin fine particle. When the dispersion stability is high, the amount of aggregating agent is large and when the dispersion stability is low, the amount of aggregating agent is small. In addition, the amount of aggregating agent differs depending on the type of aggregating agent. When aluminum sulfate is used as the aggregating agent, the amount of aggregating agent added may be 0.1 wt % to 50 wt %, and preferably 0.5 wt % to 10 wt % with respect to the fine particle. After adding the aggregating agent, for example, when an aggregating agent such as aluminum sulfate having strong aggregating property is used, it is possible to obtain a particle having a particle size of 0.1 μm to 10 μm. In contrast, for example, when an aggregating agent such as sodium chloride having weak aggregating property is used, in some cases, aggregation does not occur at the time of adding the aggregating agent. When the aggregating agent is added, a rotor and stator type dispersing machine may be used in order to prevent the fine particle from being rapidly aggregated. Similarly, in order to prevent the particle from being rapidly aggregated, a pH adjusting agent or a surfactant may be added to the fine particle dispersion liquid before the aggregating agent is added. It is possible to make the particle size of the finally obtained toner to be uniform.

If the signs of zeta potentials of the fragrance-containing microcapsule and the fine particle of the matrix resin (or its component) of the time when aggregation starts are set reverse, a binder layer is uniformly formed since the matrix resin fine particle is easily hetero-aggregated in the periphery of the fragrance-containing microcapsule, and therefore, it is possible to prevent the microcapsule from being exposed on the surface of the toner particle as much as possible. It is possible to more uniformly hetero-aggregate the matrix resin fine particle by stabilizing the matrix resin fine particle in the periphery of the fragrance-containing microcapsule as the proportion of the particles which have reverse signs of zeta potential average values to each of the microcapsule particle and the matrix resin fine particle is small. In the exemplary embodiments, it is possible to use a surfactant or a pH adjusting agent of reverse polarity in order to adjust the zeta potentials of the fragrance-containing microcapsule and the matrix resin fine particle which are dispersion particles in the dispersion liquid. It is possible to reduce negative values of the zeta potentials of the dispersion particles or to reverse the values to be positive by adding a cationic surfactant. In contrast, it is possible to reduce positive values of the zeta potentials of the dispersion particles or to reverse the values to be negative by adding an anionic surfactant. In addition, it is possible to adjust the positive and negative values of the zeta potentials by adjusting the pH when the dispersion particles are amphoteric compounds.

More specifically, for example, it is possible to adjust the zeta potential of the microcapsule (to be positive) by adding the (cationic) surfactant or the pH adjusting agent to the dispersion liquid of the fragrance-containing microcapsule (of which the zeta potential is negative) prior to the addition of the dispersion liquid of the matrix resin fine particle (of which the zeta potential is positive, for example).

In addition, when the matrix resin contains a mold-releasing agent, it is possible to suppress generation of a separated aggregated particle of a mold-releasing agent or generation of a toner particle in which the fragrance-containing microcapsule and the mold-releasing agent are exposed on the surface, by preparing dispersion liquid of a mold-releasing agent fine particle separately from dispersion liquid of a binder resin fine particle or by adding the mold-releasing agent fine particle dispersion liquid to the dispersion liquid of the fragrance-containing microcapsule in preference to the binder resin fine particle dispersion liquid. Accordingly, it is possible to obtain a toner excellent in developing property, transferability, filming resistance, and offset resistance. That is, resin coating on the fragrance-containing microcapsule becomes more uniform, and therefore, the dispersion of the fragrance-containing microcapsules in the toner particle becomes more uniform by setting the concentration in an initial period of the aggregating to be rich in the mold-releasing agent (of which the concentration is larger than the average concentration of the mold-releasing agent contained in the entire toner particle) and the concentration in the second half (in a side of the surface of the toner particle) to be rich in the binder resin (of which the concentration is smaller than the average concentration of the mold-releasing agent contained in the entire toner particle). Particularly, it is preferable that the surface of the toner particle do not have the mold-releasing agent. However, during the aggregation, when the mold-releasing agent and the resin are simply added to the dispersion liquid of the fragrance-containing microcapsule in this order, the mold-releasing agent is hardly attached to the periphery of the fragrance-containing microcapsule. Therefore, when the mold-releasing agent is added, it is preferable to add the mold-releasing agent while it is mixed with a comparatively small amount of resin.

It is preferable to heat the dispersion liquid containing the toner particle which is formed through the aggregation as described above to at least the glass transition temperature Tg of the binder resin or higher, for example, in a temperature range between 40° C. and 95° C. to promote fusion between the aggregated particles, and to densify the layer of the matrix resin. It is preferable that, prior to the heating and fusing in which it is possible to select the binder resin, the mold-releasing agent, or the like so as to perform the fusion in the above-described temperature range, stabilizers such as a pH adjusting agent, a surfactant, and the like be added as necessary and that the aggregated particles be stabilized.

In some cases, the aggregation and the fusion are simultaneously performed depending on the type of fine particle, the concentration of solid contents, and the type of aggregating agent.

In addition, the stirring condition in the aggregation and the fusion greatly affects particle size and distribution thereof. A condition that provides adequate shearing may be good for the condition of the stirring rate. When the shearing is too weak, the particle size becomes large and coarse particles are easily generated. In contrast, when the shearing is too strong, the particle size becomes small and fine powders are easily generated. In addition, a baffle may be provided in a reaction tank. The baffle has effects of suppressing foam entrapment, making the stirring state in the tank uniform, and making the shearing strong. In addition to the stirring condition, the temperature rising rate, the addition rate of additives, and the like also greatly affect the size of the particle and the particle size distribution.

It is possible to coat the surface of the aggregated particle using resin if necessary. As a first method of the coating, there is a method in which a resin particle or the like is added to dispersion liquid of the aggregated particle, the resin particle or the like is adhered to the surface of the aggregated particle by adding a aggregating agent, adjusting the pH, and the like, and subsequently the resin particle or the like except for the mold-releasing agent is fused onto the surface of the aggregated particle. As a second method of the coating, there is a method of making the surface of the aggregated particle to be included or to swell by a monomer by adding a polymerizable monomer to the aggregated particle-containing solution, and subsequently polymerizing the monomer. As a third method of the coating, there is a method of cleaning and drying the particle after fusing the aggregated particle, and making the resin particle or the like except for the mold-releasing agent be mechanically adhered to the surface of the fused particle using a hybridizer or the like.

Among these, the first method is simple and it is possible to obtain a toner with a high coating ratio. In the method, it is possible to obtain a resin particle for coating through the above-described atomization method.

That is, it is possible to form a pseudo-capsule layer on the surface of the toner particle by leaving a portion of the binder resin configuring the matrix resin, for example, 10% to 90% (and the electrification control agent as necessary) up to the above-described aggregating, adding the fine particle dispersion liquid to the dispersion liquid containing the above-described aggregated toner particle, and further continuing the aggregation and the heating and fusing. Accordingly, it is possible to prevent the fragrance-containing microcapsule from being destructed during the image forming process and fragrance components from being volatilized, or to prevent any contamination on each member. In addition, it is possible to favorably maintain electrification stability.

It is possible to obtain a toner particle having a volume average particle size of generally 3 μm to 20 μm and preferably 3 μm to 15 μm by performing cleaning, solid and liquid separation, and drying, after forming the aggregated and fused particle which has passed through the above-described process.

As a cleaning device, for example, a centrifugal separator and a filter press are favorably used. As a cleaning liquid, for example, water, ion-exchanged water, purified water, water adjusted to have acidity, and water adjusted to have basicity are used.

As a drying device, for example, a vacuum dryer, an air conveying drier, and a fluid drier are favorably used.

It is preferable that an external additive be added to the toner particle obtained as described above. It is possible to add 0.01 wt % to 20 wt % of an inorganic fine particle as the external additive, with respect to the total amount of toner, to the surface of the toner particle and mix the mixture in order to adjust fluidity and electrification property with respect to the toner particle. As such an inorganic fine particle, silica, titania, alumina, strontium titanate, tin oxide, and the like having a volume average particle size of about 5 nm to 1000 nm may be used alone or in combination of two or more thereof. It is preferable that inorganic fine particles which are surface-treated by a hydrophobic agent be used in terms of improvement of environment stability. In addition, a resin fine particle having a volume average particle size of 1 μm or smaller may be externally added in addition to such inorganic oxide for improving cleaning property. It is possible to prevent the fragrance-containing microcapsule from being cracked during the image forming process by adding the external additive.

Examples of dry mixers for mixing the toner particle and the external agent include a Henschel mixer (manufactured by Mitsui Mining Co., Ltd.), a super mixer (manufactured by KAWATA MFG Co., Ltd.), Ribokon (manufactured by OKAWARA MFG. Co., Ltd.), a Nauta mixer (manufactured by Hosokawa Micron Group), Turbulizer (manufactured by Hosokawa Micron Group), Cyclomix (manufactured by Hosokawa Micron Group), a spiral pin mixer (manufactured by Pacific Machinery & Engineering Co., Ltd.), and a Redige mixer (manufactured by Matsubo Corporation).

A colorant-free toner (non-colored aromatic toner) which is formed as described above is used for forming a solid print portion or a dot-shaped print portion through electrophotography on a predetermined place (for example, the whole portions or a portion of the image or a non-image portion out of a frame) of an (image) printed medium. It is possible to provide a unique (image) printed medium using an aroma released when the microcapsule is destructed by acupressure, finger friction, and other adequate ways. In addition, a colorant-containing toner (colored aromatic toner) may be used to form an image through electrophotography. Therefore, it is possible to form an image which may disperse aromas by itself, and to contribute to uniqueness of image printing.

FIG. 1 is a schematic view of an image forming device (electrophotography device) using such a non-colored aromatic toner of an exemplary embodiment.

As shown in FIG. 1, an image forming device 20 has an intermediate transfer belt 7, a first image forming unit 17A and a second image forming unit 17B which are sequentially formed on the intermediate transfer belt 7, and a fixing device 21 which is provided downstream thereof. The first image forming unit 17A is disposed downstream of the second image forming unit 17B along the movement direction of the intermediate transfer belt 7, in other words, along the travelling direction of the image forming process.

The first image forming unit 17A has following elements: a photoreceptor drum 1*a*; a cleaning device 16*a*, an electrification device 2*a*, an exposure device 3*a*, and a first developing unit 4*a* which are sequentially provided on the photoreceptor drum 1*a*; and a primary transfer roller 8*a* which is provided so as to face the photoreceptor drum 1*a* through the intermediate transfer belt 7. The first developing unit 4*a* accommodates a toner (non-aromatic colored toner) which contains a colorant but does not contain a fragrance-containing microcapsule.

The non-aromatic colored toner may be a toner containing binder resin, colorant, wax, and the like, and may be manufactured through a various methods such as a grinding method, a polymerizing method, and an aggregating method. It is preferable to use a pigment-based colorant for the colorant.

The second image forming unit 17B has following elements: a photoreceptor drum 1*b*; a cleaning device 16*b*, an electrification device 2*b*, an exposure device 3*b*, and a second developing unit 4*b* which are sequentially provided on the photoreceptor drum 1*b*; and a primary transfer roller 8*b* which is provided so as to face the photoreceptor drum 1*b* through the intermediate transfer belt 7. The second developing unit 4*b* accommodates a transparent toner (non-colored aromatic toner) which does not contain a colorant but contains a fragrance-containing microcapsule.

A secondary transfer roller 9 and a backup roller 10 are disposed downstream of the second image forming unit 17B so as to face to each other through the intermediate transfer belt 7. The non-aromatic colored toner within the first developing unit 4*a* and the non-colored aromatic toner within the second developing unit 4*b* may be set to be supplied from a toner cartridge, which is not shown.

Primary transfer power sources 14*a* and 14*b* are respectively connected to the primary transfer roller 8*a* and the primary transfer roller 8*b*. A secondary transfer power source 15 is connected to the secondary transfer roller 9.

The fixing device 21 has a heat roller 11 and a press roller 12 which are disposed to face to each other.

It is possible to form an image using the device of FIG. 1, for example, as follows.

First, the photoreceptor drum 1*b* is uniformly charged by the electrification device 2*b*.

Next, exposure is performed by the exposure device 3*b* to form an electrostatic latent image. Development is performed by the non-colored aromatic toner of the second developing unit 4*b* to obtain a second toner image.

Subsequently, the photoreceptor drum 1*a* is uniformly charged by the electrification device 2*a*.

Next, exposure is performed by the exposure device 3*a* based on a first image information piece to form an electrostatic latent image.

Development is performed by the non-aromatic colored toner of the first developing unit 4*a* to form a first toner image using the non-aromatic colored toner.

The second toner image and the first toner image are sequentially transferred on the intermediate transfer belt 7 using the primary transfer rollers 8*a* and 8*b*.

The image in which the second toner image and the first toner image are sequentially layered on the intermediate transfer belt 7 is secondarily transferred onto a recording medium which is not shown through the secondary transfer roller 9 and the backup roller 10. Then, an image in which the first toner image and the second toner image are sequentially layered on a recording medium 13 is formed.

That is, the second toner image which is formed using the non-colored aromatic toner containing the fragrance-containing microcapsule exists on an uppermost layer on the recording medium. However, the toner containing the fragrance-containing microcapsule does not contain a colorant, and therefore, the toner is transparent and the first toner image is not concealed.

If the image which is fixed on the recording medium is scrubbed by a user's fingertip, the fragrance-containing microcapsule contained in the toner of the uppermost layer is destructed and an aroma is volatilized. Although the aromatic toner contained in the second developing unit 4*b* overcoats the colored toner image underneath thereof in the above-described image forming device, the first developing unit 4*a* may accommodate the non-colored aromatic toner and the second developing unit may accommodate the non-aromatic colored toner as another embodiment. In this case, the aromatic transparent toner is on the lowermost layer, and therefore, in some cases, the aroma becomes weak even if the image is scrubbed by a finger.

In the above-described embodiment, the colored toner is only a toner contained in the first developing unit 4*a*, and the color of the toner is arbitrary. In addition, the number of the developing unit accommodating the colored toner may be set to be plural. For example, there may be three developing units of yellow, magenta, and cyan, or four developing units by adding black thereto. In this case, full color images contain the aromatic toner, and therefore, the application of the aromatic toner is widened.

Furthermore, as another embodiment, the toner (aromatic colored toner) may contain a colorant and a fragrance-containing microcapsule in addition to the first developing unit 4*a* and the second developing unit 4*b*. The respective toners contained in the first developing unit 4*a* and the second developing unit 4*b* may contain desired colorants having different colors. In this case, all toners contain the fragrance-containing microcapsule, but the types of the fragrance-containing microcapsules may be the same as or different from each other. In addition, even in this case, there may be prepared three developing units of yellow, magenta, and cyan, or four developing units by adding black thereto.

EXAMPLES

Hereinafter, exemplary embodiments will be more specifically described with reference to the examples. The measurement of the physical property described in the present disclosure was performed through the following methods including the following description.

Volume Average Particle Size

All of the volume average particle sizes were obtained as 50% volume average particles (a particle which reaches 50% by volume in a manner of being accumulated from a small particle size side in the volume-based median diameter, that is, in the volume-based particle size distribution (the same applies to a case from a large particle size side)). A device of measuring the volume-based particle size distribution depending on the measurement subject is as follows.

In regards to the toner or the toner particle, "Multisizer 3" which was manufactured by Beckman Coulter, Inc. and had 100 μm of an aperture diameter (measurement particle size range: 2.0 μm to 60 μm) was used.

In regards to the fragrance-containing microcapsule and the fine particle of the matrix resin (and its component), a laser diffraction particle size analyzer ("SALD 7000" manufactured by Shimadzu Corporation; measurement particle size range: 0.01 μm to 500 μm) was used.

Zeta Potential

The zeta potentials of the microcapsule and the matrix resin (and its component) in the dispersion liquid were measured by a zeta potential measurement device ("ZEECOM ZC-300" manufactured by Microtec Co., Ltd.). The samples were adjusted such that the concentration of solid contents becomes 50 ppm, and 100 particles were evaluated through manual measurement.

Preparation of Dispersion Liquid of Fragrance-Containing Microcapsule Particle

An ethylene-maleic anhydride copolymer (product manufactured by Monsanto Chemicals: EMA-31) was heated and hydrolyzed and was set to a 5% aqueous solution, and the pH thereof was adjusted to be 4.5. 100 ml of an oily fragrance ("ORANGE-CULTURE SOLUTION OIL IT" manufactured by Ogawa & Co., Ltd.) which was an encapsulated substance in 100 g of the aqueous solution was emulsified and dispersed as 2 μm to 3 μm of oil droplets using a homogenizer. Then, 50 g of an aqueous solution, in which the resin concentration was adjusted to 17% by adding pure water thereto, was added to an aqueous solution of methylol melamine resin ("Sumirez resin 613" manufactured by Sumitomo Chemical Co., Ltd.; resin concentration: 80%) while the emulsified dispersion liquid is stirred, and the stirring was further continued for 2 hours while the temperature of the system is maintained at 55° C. Accordingly, a primary film of the microcapsule was formed by adsorbing a polymer phase of the methylol melamine resin deposited in the system on the surface of the oil droplet of the oily fragrance. Next, the temperature of the system in which the microcapsule, in which the primary film was formed, was suspended was cooled to room temperature, the pH of the microcapsule slurry was lowered to 3.5 while the stirring is continued, 80 g of an aqueous solution in which the resin concentration of the aqueous solution of the methylol melamine resin was adjusted to 25% was added thereto, and the temperature of the system was increased in a range of 50° C. to 60° C.

The stirring was continued for about 1 hour after the increase of the temperature, and a secondary film was formed by adsorbing the concentrated polymer liquid, which contained a fine needle piece of the methylol melamine resin deposited in the system, on the surface of the primary film of the microcapsule. The temperature of the system was returned to room temperature and 400 g of water was added thereto. The secondary film was completely hardened by the addition of water. Accordingly, a dispersion liquid of a fragrance-containing microcapsule A was obtained. The volume average particle size of the fragrance-containing microcapsule A was 2 μm.

Example 1

Preparation of Toner

The dispersion liquid of the fragrance-containing microcapsule A obtained above was vacuum-dehydrated using a Buchner funnel and a filter paper, the dehydrated cake was spread on a tray for dry, and a powdered fragrance-containing microcapsule A was obtained.

89 parts by weight of polyester resin as binder resin (45° C. of a glass transition temperature and 100° C. of a softening point), 5 parts by weight of rice wax as a mold-releasing agent, 1 part by weight of TN-105 (manufactured by Hodogaya Chemical Co., Ltd.) as an electrification control agent, and 5 parts by weight of the fragrance-containing microcapsule A were mixed using a Henschel mixer. Then, the mixture was melted and kneaded using PCM-45 (manufactured by Ikegai Iron Works Ltd.) and was a two-axle kneading machine of which the temperature was set to 120° C. to obtain a kneaded matter. The obtained kneaded matter was ground using a jet mill after performing coarse grinding using a feather mill. Next, the ground matter was separated using a rotor-type separator to obtain a toner particle 1 having a volume average particle size of 7.6 μm. 2 parts by weight of hydrophobic silica having a volume average particle size of 30 nm and 0.5 parts by weight of titanium oxide having a volume average particle size of 20 nm with respect to 100 parts by weight of the obtained toner particle were adhered to the surface of the toner particle to obtain a toner 1.

Example 2

Preparation of Toner 83 parts by weight of styrene, 1 part by weight of an aluminum complex of a salicylic acid compound, 10 parts by weight of a fragrance-containing microcapsule A, 17 parts by weight of n-butyl acrylate, and 5 parts by weight of a polymer of terephthalic acid-propylene oxide-modified bisphenol A were prepared in a stirring tank, and were stirred for 90 minutes to prepare mixed liquid of a polymerizable monomer. After the temperature of the prepared mixed liquid of the polymerizable monomer was increased to 60° C., behenyl behenate was added to a stirring tank B such that the behenyl behenate became 13.75 parts by weight with respect to 100 parts by weight of the polymerizable monomer in the mixed liquid of the polymerizable monomer, and the stirring was further continued to obtain a polymerizable monomer composition.

97.8 parts by weight of water and 1.4 parts by weight of trisodium phosphate were stirred at 1600 rpm by increasing the temperature to 60° C., using a high-speed shear stirring atomization machine ("Clearmix" manufactured by M-tec Co., Ltd.), and the trisodium phosphate was completely dissolved. Then, an aqueous solution which was obtained by dissolving 2.50 parts by weight of calcium chloride was added thereto. After adding the aqueous solution of calcium chloride, treatment liquid was further circulated for 30 minutes to obtain an aqueous medium which was suspension of a tricalcium phosphate fine particle. The polymerizable monomer composition at 60° C. was added to the above-described aqueous medium such that the mass ratio of the aqueous medium to the polymerizable monomer composition became 2:1. The mixture was granulated for 10 minutes at 1600 rpm of rotational frequency using the Clearmix, t-butyl peroxypivalate, which is a polymerization initiator, was added thereto such that the t-butyl peroxypivalate became 7 parts by weight with respect to 100 parts by weight of the polymerizable monomer in the polymerizable monomer composition, and the mixture was granulated for 10 minutes to obtain dispersion liquid of the polymerizable monomer composition. The dispersion liquid of the polymerizable monomer composition was transferred to a polymerization tank provided with Fullzone blade (manufactured by Kobelco Eco-Solutions Co., Ltd.), and polymerization was performed for 5 hours by increasing the temperature of the liquid to 67° C.

while the polymerizable monomer composition is stirred in the polymerization tank using the Fullzone blade. Then, the temperature of the liquid was further increased to 80° C. and the polymerization process was continued for 4 hours to obtain polymer particle dispersion liquid. Hydrochloric acid was added to the obtained polymer particle dispersion liquid, and the mixture was stirred. After the tricalcium phosphate covering a polymer particle is dissolved, solid and liquid was separated in a pressure filter to obtain the polymer particle. The polymer particle was added to water and the mixture was stirred to obtain dispersion liquid again, and then solid and liquid were separated in the above-described filter. The re-dispersion into water of the polymer particle and the separation of solid and liquid were repeated until the tricalcium phosphate was sufficiently removed. Then, the polymer particle obtained by finally separating solid and liquid was sufficiently dried using an air conveying drier to obtain a dried particle having a volume average particle size of 6.2 μm. 2 parts by weight of hydrophobic silica and 0.5 parts by weight of titanium oxide with respect to 100 parts by weight of the obtained toner particle were adhered to the surface of the toner particle, and a toner 2 was obtained.

Preparation of Matrix Resin Fine Particle (Dispersion Liquid) Containing Binder Resin Preparation of Dispersion Liquid of Matrix Resin Fine Particle R1

Mechanical Emulsification Method Using Mechanical Shearing 94 parts of polyester resin as binder resin (45° C. of a glass transition temperature and 100° C. of a softening point), 5 parts of rice wax as a mold-releasing agent, and 1 part of TN-105 (manufactured by Hodogaya Chemical Co., Ltd.) as an electrification control agent were uniformly mixed using a dry mixer. Then, the mixture was melted and kneaded at 80° C. using PCM-45 which was manufactured by Ikegai Iron Works Ltd. and was a two-axle kneading machine. The obtained toner composition was ground to have 2-mm-mesh-pass particle using a pin mill, and was further ground to have an average particle size of 50 μm using a bantam mill.

Next, 0.9 parts of sodium dodecylbenzenesulfonate as a surfactant, 0.45 parts of dimethylamino ethanol as a pH adjusting agent, and 68.65 parts of ion-exchanged water were mixed, 30 parts of a ground matter of the toner composition was dispersed in the aqueous solution, and vacuum defoamation was performed to obtain dispersion liquid.

Next, using high-pressure atomizing device ("NANO 3000" manufactured by Beryu Corp.) which has following: 12 m length high-pressure pipe for heat exchange, as a heating portion, which was immersed in an oil bath; high-pressure pipe, as a pressurizing portion, which included a nozzle, on which cells having pore sizes of 0.13 μm and 0.28 μm were continuously mounted; medium-pressure pipe, as a pressure reducing portion, on which cells having pore sizes of 0.4 μm, 1.0 μm, 0.75 μm, 1.5 μm, and 1.0 μm were continuously mounted; and 12 m length heat exchange pipe, as a cooling portion, which could perform cooling using tap water, atomizing of dispersion liquid was performed at 180° C. and 150 MPa, and the pressure was reduced while the temperature is maintained at 180° C. Then, the dispersion liquid was cooled to 30° C. to obtain dispersion liquid of a matrix resin fine particle R1. The volume average particle size of the obtained particle was 0.5 μm.

Preparation of Dispersion Liquid of a Matrix Resin Fine Particle R2

Emulsion Polymerization Method

A polymerizable monomer component in which 35 parts of styrene, 3 parts of butyl acrylate, and 0.5 parts of acrylic acid as polymerizable monomers, 2 parts of dodecanethiol and 0.5 parts of carbon tetrabromide as chain transfer agents were mixed was subjected to emulsion polymerization at 70° C. for 5 hours after dissolving 0.5 parts of polyoxyethylene alkyl ether (HLB16) and 1 part of sodium dodecylbenzenesulfonate in 55.5 parts of ion-exchanged water, performing emulsification using a homogenizer in the aqueous solution, gradually adding 2 parts of 10% solution of ammonium persulfate thereto, and performing nitrogen substitution. Then, styrene-acrylic resin particle dispersion liquid having a volume average particle size of 0.1 μm, a glass transition temperature of 45° C., and a softening point of 100° C. was obtained.

Next, 30 parts of rice wax, 3 parts of sodium dodecylbenzenesulfonate, and 67 parts of ion-exchanged water were mixed and dispersed using a homogenizer (manufactured by IKA Japan KK) while the mixture is heated to 90° C. Then, the mixture was treated by Nanomizer (manufactured by Yoshida kikai Co., Ltd.) at 180 MPa and 150° C. to prepare mold-releasing agent particle dispersion liquid having a volume average particle size of 0.08 μm.

Next, 70 parts of resin particle dispersion liquid, 15 parts of releasing agent dispersion liquid, and 15 parts of ion-exchanged water were mixed to obtain dispersion liquid of a matrix resin fine particle R2.

Preparation of Dispersion Liquid of a Matrix Resin Fine Particle R3

Phase Inversion Emulsification Method 94 parts of polyester resin as binder resin (45° C. of a glass transition temperature and 100° C. of a softening point), 5 parts of rice wax as a mold-releasing agent, and 1 part of TN-105 (manufactured by Hodogaya Chemical Co., Ltd.) as an electrification control agent were uniformly mixed using a dry mixer. Then, the mixture was melted and kneaded at 80° C. using PCM-45 (manufactured by Ikegai Iron Works Ltd.) and was a two-axle kneading machine. The obtained toner composition was ground to have 2-mm-mesh-pass particle using a pin mill.

Next, 100 parts of coarsely ground material, 1.5 parts of sodium dodecylbenzenesulfonate as a surfactant, 1.5 parts of Hitenol EA-177 (HLB 16), 2.1 parts of dimethyl aminoethanol, 2 parts of potassium carbonate, and 70 parts of deionized water were added thereto, the temperature thereof was increased up to 115° C., and the mixture was stirred for 2 hours at 300 rpm of rotational frequency of stirring blade in a 1 L stirring tank with Maxblend blade. Then, 160 parts of deionized water was continuously added dropwise for 1 hour at 95° C. Then, dispersion liquid of a matrix resin fine particle R3 was obtained by cooling the mixture to room temperature. The volume average particle size of the obtained particle was 0.1 μm.

Preparation of Dispersion Liquid of a Matrix Resin Fine Particle R4

Mechanical Emulsification Method Using Mechanical Shearing 94 parts of polyester resin as binder resin (67° C. of a glass transition temperature and 135° C. of a softening point), 5 parts of rice wax as a mold-releasing agent, and 1 part of TN-105 (manufactured by Hodogaya Chemical Co., Ltd.) as an electrification control agent were uniformly mixed using a dry mixer. Then, the mixture was melted and kneaded at 80° C. using PCM-45 which was manufactured by Ikegai Iron Works Ltd. and was a two-axle kneading machine. The obtained toner composition was ground to have 2-mm-mesh-pass particle using a pin mill, and was further ground to have an average particle size of 50 μm using a bantam mill.

Next, 0.9 parts of sodium dodecylbenzenesulfonate as a surfactant, 0.45 parts of dimethylamino ethanol as a pH adjusting agent, and 68.65 parts of ion-exchanged water were mixed, 30 parts of a ground matter of the toner composition was dispersed in the aqueous solution, and vacuum defoamation was performed to obtain dispersion liquid.

Next, using "NANO 3000" (manufactured by Beryu Corp.) which has followings: 12 m length high-pressure pipe for heat exchange, as a heating portion, which was immersed in an oil bath; high-pressure pipe, as a pressurizing portion, which included a nozzle, on which cells having pore sizes of 0.13 μm and 0.28 μm were continuously mounted; medium-pressure pipe, as a pressure reducing portion, on which cells having pore sizes of 0.4 μm, 1.0 μm, 0.75 μm, 1.5 μm, and 1.0 μm were continuously mounted; and 12 m length heat exchange pipe, as a cooling portion, which could perform cooling using tap water, atomizing of dispersion liquid was performed at 180° C. and 150 MPa, and the pressure was reduced while the temperature is maintained at 180° C. Then, the dispersion liquid was cooled to 30° C. to obtain dispersion liquid of a matrix resin fine particle R4. The volume average particle size of the obtained particle was 0.5 μm.

Preparation of Dispersion Liquid of a Matrix Resin Fine Particle R5

Mechanical Emulsification Method Using Mechanical Shearing 99 parts by weight of polyester resin as binder resin (45° C. of a glass transition temperature and 100° C. of a softening point) and 1 part of TN-105 (manufactured by Hodogaya Chemical Co., Ltd.) as an electrification control agent were uniformly mixed using a dry mixer. Then, the mixture was melted and kneaded at 80° C. using "PCM-45" which was manufactured by Ikegai Iron Works Ltd. and was a two-axle kneading machine. The obtained toner composition was ground to have 2-mm-mesh-pass particle using a pin mill, and was further ground to have an average particle size of 50 μm using a bantam mill.

Next, 0.9 parts of sodium dodecylbenzenesulfonate as a surfactant, 0.45 parts of dimethylamino ethanol as a pH adjusting agent, and 68.65 parts of ion-exchanged water were mixed, 30 parts of a ground matter of the toner composition was dispersed in the aqueous solution, and vacuum defoamation was performed to obtain dispersion liquid.

Next, using "NANO 3000" (manufactured by Beryu Corp.) which has following: 12 m length high-pressure pipe for heat exchange, as a heating portion, which was immersed in an oil bath; high-pressure pipe, as a pressurizing portion, which included a nozzle, on which cells having pore sizes of 0.13 μm and 0.28 μm were continuously mounted; medium-pressure pipe, as a pressure reducing portion, on which cells having pore sizes of 0.4 μm, 1.0 μm, 0.75 μm, 1.5 μm, and 1.0 μm were continuously mounted; and 12 m length heat exchange pipe, as a cooling portion, which could perform cooling using tap water, atomizing of dispersion liquid was performed at 180° C. and 150 MPa, and the pressure was reduced while the temperature is maintained at 180° C. Then, the dispersion liquid was cooled to 30° C. to obtain dispersion liquid of a matrix resin fine particle R5. The volume average particle size of the obtained particle was 0.1 μm.

Preparation of Dispersion Liquid of Fine Particle S for Shell

Mechanical Emulsification Method 100 parts of polyester resin as binder resin (58° C. of a glass transition temperature and 125° C. of a softening point) was ground to have 2-mm-mesh-pass particle using a pin mill, and was further ground to have an average particle size of 50 μm using a bantam mill.

Next, 0.9 parts of sodium dodecylbenzenesulfonate as a surfactant, 0.45 parts of dimethylamino ethanol as a pH adjusting agent, and 68.65 parts of ion-exchanged water were mixed, 30 parts of polyester resin was dispersed in the aqueous solution, and vacuum defoamation was performed to obtain dispersion liquid.

Next, using "NANO 3000" (manufactured by Beryu Corp.) which has following: 12 m length high-pressure pipe for heat exchange, as a heating portion, which was immersed in an oil bath; high-pressure pipe, as a pressurizing portion, which included a nozzle, on which cells having pore sizes of 0.13 μm and 0.28 μm were continuously mounted; medium-pressure pipe, as a pressure reducing portion, on which cells having pore sizes of 0.4 μm, 1.0 μm, 0.75 μm, 1.5 μm, and 1.0 μm were continuously mounted; and 12 m length heat exchange pipe, as a cooling portion, which could perform cooling using tap water, atomizing of dispersion liquid was performed at 180° C. and 150 MPa, and the pressure was reduced while the temperature is maintained at 180° C. Then, the dispersion liquid was cooled to 30° C. to obtain dispersion liquid of a fine particle S for a shell. The volume average particle size of the obtained particle was 0.1 μm.

Preparation of Dispersion Liquid of Wax Fine Particle W 40 parts by weight of ester wax, 4 parts by weight of sodium dodecylbenzenesulfonate as an anionic surfactant, 1 part by weight of triethylamine as an amine compound, and 55 parts by weight of ion-exchanged water were mixed using a high-speed shear stirring atomization machine ("Clearmix" manufactured by M-tec Co., Ltd.) to prepare mixed liquid. The mixed liquid in the Clearmix was heated to 80° C. Then, the rotational frequency of the Clearmix was set to 6000 rpm and mechanical shearing was performed for 30 minutes. After the mechanical shearing was finished, the mixed liquid was cooled to room temperature to obtain dispersion liquid of a wax fine particle W. The volume average particle size of the wax fine particle W was 0.6 μm.

Example 3

Preparation of Toner 1.5 parts by weight of dispersion liquid of a fragrance-containing microcapsule A, 16 parts of dispersion liquid of matrix resin fine particle R1, and 83 parts of ion-exchanged water were mixed and 5 parts by weight of a 30% ammonium sulfate solution was added thereto while the mixture is stirred at 6500 rpm using a homogenizer (manufactured by IKA Japan KK). Then, the mixture was heated to 40° C. while being stirred at 800 rpm using a 1 L stirring tank provided with paddle blade. After being left for 1 hour at 40° C., 10 parts of a 10% sodium polycarboxylate aqueous solution was added thereto, heated to 68° C., and cooled after being left for 1 hour to obtain toner particle dispersion liquid. Next, filtering of the toner particle dispersion liquid and cleaning using ion-exchanged water were repeatedly performed and the cleaning was performed until the electric conductivity of the filtrate became 50 μS/cm. Then, the cleaned filtrate was dried using a vacuum drier until the water content became 1.0 wt % or less to obtain a dried particle having a volume average particle size of 7.7 μm. After the drying, 2 parts by weight of hydrophobic silica and 0.5 parts by weight of titanium oxide as additive agents with respect to 100 parts by weight of the obtained dried particle were adhered to the surface of the toner particle to obtain a toner 3.

Example 4

Preparation of Toner 1.5 parts by weight of dispersion liquid of a fragrance-containing microcapsule A, 16 parts of dispersion liquid of matrix resin fine particle R2, and 83 parts of ion-exchanged water were mixed and 5 parts by weight of a 30% ammonium sulfate solution was added thereto while the mixture is stirred at 6500 rpm using a homogenizer (manufactured by IKA Japan KK). Then, the mixture was heated to 40° C. while being stirred at 800 rpm using a 1 L stirring tank provided with paddle blade. After being left for 1 hour at 40° C., 10 parts of a 10% sodium polycarboxylate aqueous solution was added thereto, heated to 68° C., and cooled after being left for 1 hour to obtain toner particle dispersion liquid. Next, filtering of the toner particle dispersion liquid and cleaning using ion-exchanged water were repeatedly performed and the cleaning was performed until the electric conductivity of the filtrate became 50 μS/cm. Then, the cleaned filtrate was dried using a vacuum drier until the water content became 1.0 wt % or less to obtain a dried particle having a volume average particle size of 7.8 μm. After the drying, 2 parts by weight of hydrophobic silica and 0.5 parts by weight of titanium oxide as additive agents with respect to 100 parts by weight of the obtained dried particle were adhered to the surface of the toner particle to obtain a toner 4.

Example 5

Preparation of Toner 1.5 parts by weight of dispersion liquid of a fragrance-containing microcapsule A, 16 parts of dispersion liquid of matrix resin fine particle R3, and 83 parts of ion-exchanged water were mixed and 5 parts by weight of a 30% ammonium sulfate solution was added thereto while the mixture is stirred at 6500 rpm using a homogenizer (manufactured by IKA Japan KK). Then, the mixture was heated to 40° C. while being stirred at 800 rpm using a 1 L stirring tank provided with paddle blade. After being left for 1 hour at 40° C., 10 parts of a 10% sodium polycarboxylate aqueous solution was added thereto, heated to 68° C., and cooled after being left for 1 hour to obtain toner particle dispersion liquid. Next, filtering of the toner particle dispersion liquid and cleaning using ion-exchanged water were repeatedly performed and the cleaning was performed until the electric conductivity of the filtrate became 50 μS/cm. Then, the cleaned filtrate was dried using a vacuum drier until the water content became 1.0 wt % or less to obtain a dried particle having a volume average particle size of 7.5 μm. After the drying, 2 parts by weight of hydrophobic silica and 0.5 parts by weight of titanium oxide as additive agents with respect to 100 parts by weight of the obtained dried particle were adhered to the surface of the toner particle to obtain a toner 5.

Example 6

Preparation of Toner 1.5 parts by weight of dispersion liquid of a fragrance-containing microcapsule A, 16 parts of dispersion liquid of matrix resin fine particle R1, and 83 parts of ion-exchanged water were mixed and 5 parts by weight of a 30% ammonium sulfate solution was added thereto while the mixture is stirred at 6500 rpm using a homogenizer (manufactured by IKA Japan KK). Then, the mixture was heated to 40° C. while being stirred at 800 rpm using a 1 L stirring tank provided with paddle blade. After being left for 1 hour at 40° C., 3 parts of dispersion liquid of a particle S for a shell was added thereto, and 1 part of a 0.5% aluminum sulfate aqueous solution was added thereto. Then, 10 parts of a 10% sodium polycarboxylate aqueous solution was added thereto, heated to 68° C., and cooled after being left for 1 hour to obtain toner particle dispersion liquid. Next, filtering of the toner particle dispersion liquid and cleaning using ion-exchanged water were repeatedly performed and the cleaning was performed until the electric conductivity of the filtrate became 50 μS/cm. Then, the cleaned filtrate was dried using a vacuum drier until the water content became 1.0 wt % or less to obtain a dried particle having a volume average particle size of 8.0 μm. After the drying, 2 parts by weight of hydrophobic silica and 0.5 parts by weight of titanium oxide as additive agents with respect to 100 parts by weight of the obtained dried particle were adhered to the surface of the toner particle to obtain a toner 6.

Example 7

Preparation of Toner 1.5 parts by weight of dispersion liquid of a fragrance-containing microcapsule A, 16 parts of dispersion liquid of matrix resin fine particle R4, and 83 parts of ion-exchanged water were mixed and 5 parts by weight of a 30% ammonium sulfate solution was added thereto while the mixture is stirred at 6500 rpm using a homogenizer (manufactured by IKA Japan KK). Then, the mixture was heated to 40° C. while being stirred at 800 rpm using a 1 L stirring tank provided with paddle blade. After being left for 1 hour at 40° C., 10 parts of a 10% sodium polycarboxylate aqueous solution was added thereto, heated to 68° C., and cooled after being left for 1 hour to obtain toner particle dispersion liquid. Next, filtering of the toner particle dispersion liquid and cleaning using ion-exchanged water were repeatedly performed and the cleaning was performed until the electric conductivity of the filtrate became 50 μS/cm. Then, the cleaned filtrate was dried using a vacuum drier until the water content became 1.0 wt % or less to obtain a dried particle having a volume average particle size of 7.8 μm. After the drying, 2 parts by weight of hydrophobic silica and 0.5 parts by weight of titanium oxide as additive agents with respect to 100 parts by weight of the obtained dried particle were adhered to the surface of the toner particle to obtain a toner 7.

Example 8

Preparation of Toner

While 1.5 parts by weight of dispersion liquid of a fragrance-containing microcapsule A is stirred at 6500 rpm using a homogenizer (IKA Japan KK), 2.5 parts by weight of a 0.5% polydiaryl dimethyl ammonium chloride solution was added thereto. Then, the average value of zeta potentials changed from −68 mV to +35 mV. At this time, the proportion of a particle having a negative zeta potential which was reverse to the average value in distribution of zeta potentials was 3% by number. Next, 5 parts by weight of 30% ammonium sulfate solution was added thereto. Then, the mixture was heated to 40° C. while being stirred at 800 rpm using a 1 L stirring tank which was provided with paddle blade. After holding the temperature at 40° C. for 1 hour, a solution in which 16 parts of dispersion liquid of a matrix resin fine particle R5 and 83 parts of ion-exchanged water were mixed was gradually added thereto over 10 hours. Subsequently, 10 parts of a 10% sodium polycarboxylate aqueous solution was added thereto, heated to 68° C., and cooled after being left for 1 hour to obtain toner particle dispersion liquid. Next, filtering of the toner particle dispersion liquid and cleaning using ion-exchanged water were repeatedly performed and the cleaning was performed until the electric conductivity of the filtrate became 50 μS/cm. Then, the cleaned filtrate was dried using a vacuum drier until the water content became 1.0 wt % or less to obtain a dried particle having a volume average particle size of 7.8 μm. After the drying, 2 parts by weight of hydrophobic silica and 0.5 parts by weight of titanium oxide as additive agents with respect to 100 parts by weight of the obtained dried particle were adhered to the surface of the toner particle to obtain a toner 8.

Example 9

Preparation of Toner

While 1.5 parts by weight of dispersion liquid of a fragrance-containing microcapsule A is stirred at 6500 rpm using a homogenizer (IKA Japan KK), 2.5 parts by weight of a 0.5% polydiaryl dimethyl ammonium chloride solution was added thereto. Then, the average value of zeta potentials changed from −68 mV to +35 mV. At this time, the proportion of a particle having a negative zeta potential which was reverse to the average value in distribution of zeta potentials was 3% by number. Next, 5 parts by weight of 30% ammonium sulfate solution was added thereto. Then, the mixture was heated to 40° C. while being stirred at 800 rpm using a 1 L stirring tank which was provided with paddle blade. After holding the temperature at 40° C. for 1 hour, a solution in which 2.7 parts by weight of dispersion liquid of a matrix resin fine particle R5, 1.3 parts by weight of wax particle dispersion liquid W, and 10 parts by weight of ion-exchanged water were mixed and stirred was added thereto. Then, the mixture was heated to 40° C. while being stirred at 800 rpm using a 1 L stirring tank which was provided with paddle blade. After holding the temperature at 40° C. for 1 hour, a solution in which 13.3 parts by weight of dispersion liquid of a matrix resin fine particle R5 and 73 parts by weight of ion-exchanged water were mixed was gradually added thereto over 10 hours. Subsequently, 10 parts by weight of a 10% sodium polycarboxylate aqueous solution was added thereto, heated to 68° C., and cooled after being left for 1 hour to obtain toner particle dispersion liquid. Next, filtering of the toner particle dispersion liquid and cleaning using ion-exchanged water were repeatedly performed and the cleaning was performed until the electric conductivity of the filtrate became 50 μS/cm. Then, the cleaned filtrate was dried using a vacuum drier until the water content became 1.0 wt % or less to obtain a dried particle having a volume average particle size of 8.0 μm. After the drying, 2 parts by weight of hydrophobic silica and 0.5 parts by weight of titanium oxide as additive agents with respect to 100 parts by weight of the obtained dried particle were adhered to the surface of the toner particle to obtain a toner 9.

Preparation of Dispersion Liquid of Pigment Fine Particle P 7 parts by weight of a cyan pigment as a colorant, 0.1 parts by weight of sodium dodecylbenzenesulfonate as an anionic surfactant, 0.1 parts by weight of triethylamine as an amine compound, and 92.8 parts by weight of ion-exchanged water were mixed using Clearmix to prepare mixed liquid. After adjusting the temperature of the mixed liquid in the Clearmix to 30° C., the rotational frequency of the Clearmix was set to 300 rpm and the mechanical shearing was performed for 10 minutes to obtain dispersion liquid of a pigment fine particle P. The volume average particle size of the pigment fine particle P was 200 nm.

Example 10

Preparation of Toner 1.5 parts by weight of dispersion liquid of a fragrance-containing microcapsule A, 3.5 parts by weight of dispersion liquid of a pigment fine particle P, 15 parts of dispersion liquid of matrix resin fine particle R1, and 83 parts of ion-exchanged water were mixed and 5 parts by weight of a 30% ammonium sulfate solution was added thereto while the mixture is stirred at 6500 rpm using a homogenizer (manufactured by IKA Japan KK). Then, the mixture was heated to 40° C. while being stirred at 800 rpm using a 1 L stirring tank provided with paddle blade. After being left for 1 hour at 40° C., 10 parts of a 10% sodium polycarboxylate aqueous solution was added thereto, heated to 68° C., and cooled after being left for 1 hour to obtain toner particle dispersion liquid. Next, filtering of the toner particle dispersion liquid and cleaning using ion-exchanged water were repeatedly performed and the cleaning was performed until the electric conductivity of the filtrate became 50 μS/cm. Then, the cleaned filtrate was dried using a vacuum drier until the water content became 1.0 wt % or less to obtain a dried particle having a volume average particle size of 7.9 μm. After the drying, 2 parts by weight of hydrophobic silica and 0.5 parts by weight of titanium oxide as additive agents with respect to 100 parts by weight of the obtained dried particle were adhered to the surface of the toner particle to obtain a toner 10.

Evaluation of Fragrance of Printed Matter

A developer, which was prepared by mixing each of the obtained non-colored aromatic toners 1 to 10 with a ferrite carrier which was coated with silicone resin such that the toner ratio concentration became 8%, was added to an electrophotographic multifunctional machine ("e-studio 2050c" manufactured by Toshiba Tec Corporation; The e-studio 2050c" is originally an electrophotography device having four kinds of image forming units which have a function as the image forming unit 17A of FIG. 1 using a non-aromatic colored toner and of which only a unit is set to be usable as the non-colored aromatic toner 17B of FIG. 1) and the fixing temperature was set to 150° C. Then, a solid image was printed on a paper and left for 1 week under conditions of room temperature and normal humidity (23° C. and 60% RH). The printed matter after being left was scrubbed by a finger 5 times in a direction at a speed of about 15 cm/s over a width of 3 cm and a length of 10 cm such that about 50 g/cm$^2$ of finger pressure was applied to the printed matter, and intensity of the fragrance was evaluated. The evaluation was performed based on the following criteria as an average of 10 assessors.

A: It is possible to recognize the fragrance even if the paper is separated from a nose by about 30 cm.

B: It is possible to recognize some fragrance even if the paper is separated from a nose by about 30 cm, and it is possible to well recognize the fragrance when the paper is brought closer to the nose.

C: It is possible to recognize an extremely slight fragrance when the paper is separated from a nose by about 30 cm, and it is possible to recognize the fragrance when the paper is brought closer to the nose.

D: It is impossible to recognize the fragrance when the paper is separated from a nose by about 30 cm, but it is possible to recognize the fragrance when the paper is brought closer to the nose.

E: It is possible to recognize some fragrance when the paper is brought closer to a nose, or alternately, it is impossible to recognize the fragrance at all.

Evaluation of Fragrance-Containing Microcapsule Exposed on Surface

The exposure of a fragrance-containing microcapsule on a surface of a toner particle in a toner was evaluated through SEM observation. More specifically, total 100 toner particles were sampled and the proportion of toner particles having the fragrance-containing microcapsule which was exposed on the surface thereof was measured. The evaluation was performed based on the following criteria.

A: Toners having the fragrance-containing microcapsule which is exposed on the surface thereof are less than 10% by number.

B: Toners having the fragrance-containing microcapsule which is exposed on the surface thereof are less than 10% by number, or alternately, there are many separated fragrance-containing microcapsules.

A summary of each example and evaluation result are shown altogether in the following Table 1.

INDUSTRIAL APPLICABILITY

As described above, according to the exemplary embodiments, a toner which may maintain dispersion of aromas over a long period of time and a simple method of producing the same are provided. In addition, referring to the above-described Table 1, the effect of maintaining the dispersion of aromas is satisfactory when a wet granulation method is used (Examples 2 to 10). In particular, when the aggregation method is used (Examples 3 to 10), toner having binder resin having a properly set glass transition temperature (Examples 3 to 6, 8, and 9) shows preferable results. Moreover, it was confirmed that the effect thereof is particularly excellent in a toner particle (Example 6) having a capsule coating on an outermost layer or in a toner particle (Examples 8 and 9) obtained by preparing a zeta potential of a dispersion particle prior to the aggregation.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

TABLE 1

| Examples | Production method | Matrix resin fine particle | Potential adjustment before aggregation | Evaluation of fragrance | Fragrance-containing capsule |
|---|---|---|---|---|---|
| 1 | Grinding | — | None | D | Unevaluated |
| 2 | Suspension Polymerization | — | None | C | Unevaluated |
| 3 | Aggregation | R1 | None | B | B |
| 4 | Aggregation | R2 | None | B | Unevaluated |
| 5 | Aggregation | R3 | None | B | Unevaluated |
| 6 | Aggregation | R1 + S | None | A | Unevaluated |
| 7 | Aggregation | R4 | None | C | Unevaluated |
| 8 | Aggregation | R5 | Yes | A | A |
| 9 | Aggregation | R5 + W + R5 | Yes | A | A |
| 10 | Aggregation | R1 + P | None | B | Unevaluated |

A summary of the matrix resin fine particles in Table 1 is shown in the following Table 2.

TABLE 2

| Matrix resin | Production method | Component | Tg (° C.) | Softening point (° C.) | Particle size (μm) |
|---|---|---|---|---|---|
| Fine particle R1 | Mechanical emulsification | Polyester + rice wax | 45 | 100 | 0.5 |
| Fine particle R2 | Emulsion polymerization | Polyester + rice wax | 45 | 100 | 0.1 + 0.08 |
| Fine particle R3 | Phase inversion emulsification | Polyester + rice wax | 45 | 100 | 0.1 |
| Fine particle R4 | Mechanical emulsification | Polyester + rice wax | 67 | 135 | 0.5 |
| Fine particle R5 | Mechanical emulsification | Polyester | 45 | 100 | 0.1 |
| Shell fine particle S | Mechanical emulsification | Polyester | 58 | 125 | 0.1 |
| Wax fine particle W | High-speed stirring | Ester wax | — | — | 0.08 |
| Pigment fine particle P | High-speed stirring | Cyan pigment | — | — | 0.2 |

What is claimed is:

1. A toner comprising: toner particles, each containing binder resin and a plurality of microcapsules dispersed therein, each of the microcapsules containing a liquid material.

2. The toner according to claim 1, wherein
the liquid material is volatile.

3. The toner according to claim 1, wherein
the liquid material is a fragrant material.

4. The toner according to claim 1, wherein
the liquid material is diluted with a non-fragrant solvent.

5. The toner according to claim 1, wherein
each of the toner particles contains a colorant.

6. The toner according to claim 5, wherein
the colorant is dispersed in the binder resin.

7. The toner according to claim 1, wherein
the glass transition temperature of the binder resin is equal to or greater than 25° C. and equal to or smaller than 65° C.

8. The toner according to claim 1, wherein
each of the toner particles is coated by a capsule layer formed mainly of the binder resin.

9. The toner according to claim 1, wherein
the toner particles are formed through melting the binder resin and kneading the melted binder resin with the microcapsules.

10. The toner according to claim 1, wherein
the toner particles are formed through granulating the binder resin in an aqueous medium that contains the microcapsules.

11. The toner according to claim 10, wherein
the toner particles are formed by aggregating the microcapsules and a particle of the binder resin in an aqueous medium.

12. A method for forming an image on a medium, comprising:
forming an electrostatic latent region;
forming a toner image on the electrostatic latent region using a toner including toner particles, each containing binder resin and a plurality of microcapsules dispersed therein, each of the microcapsules containing a liquid material;
transferring the formed toner image onto a medium; and
fixing the transferred toner image on the medium.

13. The method according to claim 12, wherein
the transferring and the fixing are carried out such that at least a part of the microcapsules are formed on the medium without being broken.

14. The method according to claim 13, wherein
the forming of the toner, the transferring, and the fixing are carried out such that the microcapsules formed on the medium are broken when the microcapsules contact an object.

15. The method according to claim 12, wherein
the liquid material is volatile.

16. The method according to claim 15, wherein
the liquid material is a fragrant material.

17. The method according to claim 16, further comprising:
applying pressure to the fixed toner on the medium, such that the microcapsules are broken and aroma of the fragrant material is released.

18. An image forming apparatus comprising:
an electrostatic latent image forming unit configured to form an electrostatic latent image on an image carrier;
a developing unit configured to form a toner image by developing the electrostatic latent image using a toner comprising toner particles, each containing binder resin and a plurality of microcapsules dispersed therein, each of the microcapsules containing a liquid material;
a transferring unit configured to transfer the toner image formed by the developing unit, onto a recording medium; and
a fixing unit configured to fix the toner image transferred by the transferring unit on the recording medium.

19. The apparatus according to claim 18, wherein
the liquid material is volatile.

20. The apparatus according to claim 19, wherein
the liquid material is a fragrant material.

* * * * *